US005918549A

United States Patent [19]

Basile et al.

[11] Patent Number: 5,918,549

[45] Date of Patent: Jul. 6, 1999

[54] RAILWAY FREIGHT CAR METAL FLOOR

[75] Inventors: Fred M. Basile, Arden, N.C.; Michael W. DiLuigi, Darien, Ill.; Charles D. Womack, Canton, N.C.

[73] Assignee: TRN Business Trust, Dallas, Tex.

[21] Appl. No.: 08/837,285

[22] Filed: Apr. 11, 1997

Related U.S. Application Data

[60] Provisional application No. 60/015,778, Apr. 16, 1996.

[51] Int. Cl.[6] ..... B61D 17/10

[52] U.S. Cl. ..... 105/422

[58] Field of Search ..... 105/413, 416, 105/418, 419, 422; 296/181, 183, 204; 52/578, 579, 588.1, 582.1, 583.1, 630

[56] References Cited

U.S. PATENT DOCUMENTS

| | | | |
|---|---|---|---|
| 2,478,993 | 8/1949 | Wing | 105/422 |
| 2,783,718 | 3/1957 | Cheshire | 105/419 |
| 3,145,667 | 8/1964 | Shaver | 105/422 |
| 3,185,112 | 5/1965 | Johnston | 105/409 |
| 3,194,184 | 7/1965 | Murray | 105/422 |
| 3,266,441 | 8/1966 | Pulcrano | 105/416 |
| 3,420,192 | 1/1969 | Ellis | 105/422 |
| 3,528,376 | 9/1970 | Curtis, Jr. | 105/422 |
| 3,777,671 | 12/1973 | Miller et al. | 105/422 |
| 3,885,506 | 5/1975 | Mundinger et al. | 105/367 |
| 4,224,880 | 9/1980 | Hogue et al. | 105/422 |
| 4,288,957 | 9/1981 | Meehan | 52/460 |
| 4,645,258 | 2/1987 | Ohmura et al. | 296/204 |
| 4,794,032 | 12/1988 | Fujii et al. | 428/209 |
| 4,951,992 | 8/1990 | Hockney | 296/204 |
| 4,966,082 | 10/1990 | Takeichi et al. | 105/422 |
| 5,287,814 | 2/1994 | Masai et al. | 105/422 |
| 5,309,845 | 5/1994 | Onishi | 105/418 |
| 5,370,482 | 12/1994 | Long | 410/153 |
| 5,386,674 | 2/1995 | Sfirakis et al. | 52/243.1 |
| 5,403,063 | 4/1995 | Sjostedt et al. | 296/187 |
| 5,581,969 | 12/1996 | Kelleher | 52/630 |

FOREIGN PATENT DOCUMENTS

| | | | |
|---|---|---|---|
| 229762 | 9/1989 | Japan | 105/422 |

*Primary Examiner*—Mark T. Le
*Attorney, Agent, or Firm*—Baker & Botts, L.L.P.

[57] ABSTRACT

A floor structure for attachment to a railway car underframe is provided. The floor structure is formed in part from floor panels having a floor plate and a number of reinforcing members attached to one side of each floor plate. One of the reinforcing members is preferably attached along a first edge of each floor with a portion of the reinforcing member extending laterally from the respective first edge. The opposite edge of the floor plate perfectly extends laterally from the nearest reinforcing member such that when the floor panels are disposed adjacent to each other with the second edge of one floor plate resting on the reinforcing member extending from the first edge of an adjacent floor plate. A butt weld is preferably formed between each adjacent first edge and second edge and the respective reinforcing member. The ends of the floor plates may be bent downwardly for connection to portions of the underframe. The length of the floor panels may be less than the distance between side sills to accommodate a bulkhead track and divider assembly.

11 Claims, 8 Drawing Sheets

RAILWAY FREIGHT CAR METAL FLOOR

RELATED APPLICATIONS

This application claims the benefit of U.S. Provisional Application Ser. No. 60/015,778, filed Apr. 16, 1996.

TECHNICAL FIELD OF THE INVENTION

This invention relates generally to modular construction of a floor for vehicles and, more particularly, to a metal floor structure attached to a railway car underframe for railway freight cars.

BACKGROUND OF THE INVENTION

Over the years, railway boxcars and freight cars have progressed from relatively simple general purpose wooden structures mounted on flat cars to more elaborate arrangements including insulated walls, refrigeration equipment, nailable metal floors, and other features for specific applications. Various types of railway boxcars and freight cars are presently manufactured and used. A typical railway freight car includes an enclosed structure mounted on a railway car underframe. The enclosed structure may include an outer shell and interior paneling. For some freight cars, such as refrigerated box cars, one or more layers of insulation may be disposed between the outer shell and the interior paneling.

The outer shell of a railway freight car often has an exterior surface formed from various types of metal such as steel or aluminum alloys. The interior paneling is often formed from wood and/or metal as desired for the specific application. Sliding doors are generally provided on each side of the enclosed structure for loading and unloading freight. Conventional railway freight cars may be assembled from various pieces of wood, steel and/or sheets of composite material such as fiberglass reinforced plastic and generally require significant amounts of raw material, labor and time to complete manufacture and assembly of each freight car.

The underframe for many railway freight cars includes a center sill with a pair of end sills and a pair of side sills arranged in a rectangular configuration corresponding approximately with the dimensions for the floor of the freight car. Cross bearers and cross ties are often provided to establish the desired rigidity and strength for transmission of vertical loads to the center sill. A plurality of longitudinal stringers are typically provided on each side of the center sill to support the floor of the enclosed structure. Examples of such railway car underframes are shown in U.S. Pat. Nos. 2,783,718 and 3,266,441. Both of these patents are incorporated by reference for all purposes within this application.

For many years various techniques have been used to provide nailable steel floors for railway freight cars. The Association of American Railroads (AAR) Mechanical Division Manual of Standards and Recommended Practices, Specification M-964-92 provides information concerning the manufacture and testing of such nailable steel floors. U.S. Pat. No. 4,224,880 entitled "Railway Car Nailable Floor" provides additional information concerning such floors. This patent is incorporated by reference for all purposes within this application.

Various types of load dividers and freight securing systems have previously been used to prevent undesired movement of freight contained within an enclosed structure of a railway freight car. The use of such systems is particularly important when the freight car is only partially loaded.

Examples of such systems are shown in U.S. Pat. No. 5,370,482 entitled "Cargo Securement System" and U.S. Pat. No. 5,386,674 entitled "Two Piece Bulkhead Door for Rail Cars and the Like." The above patents are incorporated by reference for all purposes within this application.

Nailable metal floors provide advantages over wooden floors. A typical nailable metal floor structure may include multiple floor panels. However, the floor panels are typically comprised of several nested metal planks. This results in complex construction of the floor panels and a series of grooves in each floor panel. Also, an additional metal strip must be applied across each end of the panel to "finish" the panel ends.

SUMMARY OF THE INVENTION

In accordance with the present invention, disadvantages and problems associated with previous modular floors for railway freight cars have been addressed. The present invention provides a nailess floor structure which may be assembled from floor panels to provide a smooth floor surface extending throughout the interior of the resulting railway freight car. The floor panels are preferably fabricated from appropriate metallic and/or nonmetallic materials in accordance with teachings of the present invention prior to assembly of the associated railway freight cars.

One aspect of the present invention includes providing metal floor panels which may be fabricated prior to installation within a railway freight car. For one application, the present invention provides a metal floor structure satisfactory for use in railway freight cars subject to lift truck axle loads of 60,000 pounds. For another application, the present invention provides a metal floor satisfactory for use in railway freight cars subject to lift truck axle loads of 80,000 pounds. In both applications, the resulting metal floor structures satisfactorily passed dishing, web crushing, and beam strength tests, as defined by AAR Specification M-964-92 for nailable steel floors.

Another aspect of the present invention includes providing floor panels with bent-down end portions for coupling the floor panels to a railway car underframe and for interfacing with side sills of the underframe.

Another aspect of the present invention includes providing floor panels which include one-piece floor plates connected to one or more reinforcing members. The floor plates of adjacent floor panels may abut each other and may both be connected to a common overlapping reinforcing member.

Technical advantages of the present invention include providing a floor structure with a smooth metal surface while minimizing the weight and, at the same time, maximizing the strength of the floor structure. Floor panels may be fabricated in accordance with the teachings of the present invention for attachment to a wide variety of railway car underframes such that the time required to install the resulting floor structure during assembly of the associated railway freight car is substantially reduced. The floor panels may be fabricated prior to assembly of the associated freight car to minimize the total number of parts that must be handled during assembly of the floor structure. Floor panels and floor plates incorporating teachings of the present invention allow relatively easy access to those locations which require welding of the resulting floor structure to the associated railway car underframe. Using standardized floor panels to form the floor structure in a large number of railway freight cars allows reducing both manufacturing costs and material costs associated with each floor panel and also reduces the amount of time, material and labor associated with installation of each floor structure in the associated railway freight car. A floor structure formed in accordance with the teachings of the present invention is particularly adapted for use in freight cars carrying products such as rolls of paper or automobile parts which are preferably shipped on a smooth floor surface.

Further technical advantages of the present invention include providing a number of floor panels having a generally rectangular configuration. Each floor panel preferably includes a floor plate with a plurality of reinforcing members attached to one side of the floor plate. One reinforcing member is preferably attached to and partially extends laterally from one edge of each floor plate such that the other edge of an adjacent floor plate may be welded to the portion of the reinforcing member. The ends of each floor plate are preferably bent downwardly for use in attaching the respective floor panel with portions of the railway car underframe. The combination of providing a butt weld between the adjacent edges of each floor plate and bending down the opposite ends of each floor plate results in a floor structure with no leaks between adjacent floor panels and around the perimeter of the resulting floor structure.

BRIEF DESCRIPTION OF THE DRAWINGS

For a more complete understanding of the present invention, and the advantages thereof, reference is now made to the following detailed description of the preferred embodiments taken in conjunction with the accompanying drawings, in which.

DETAILED DESCRIPTION OF THE INVENTION

Figure 1:
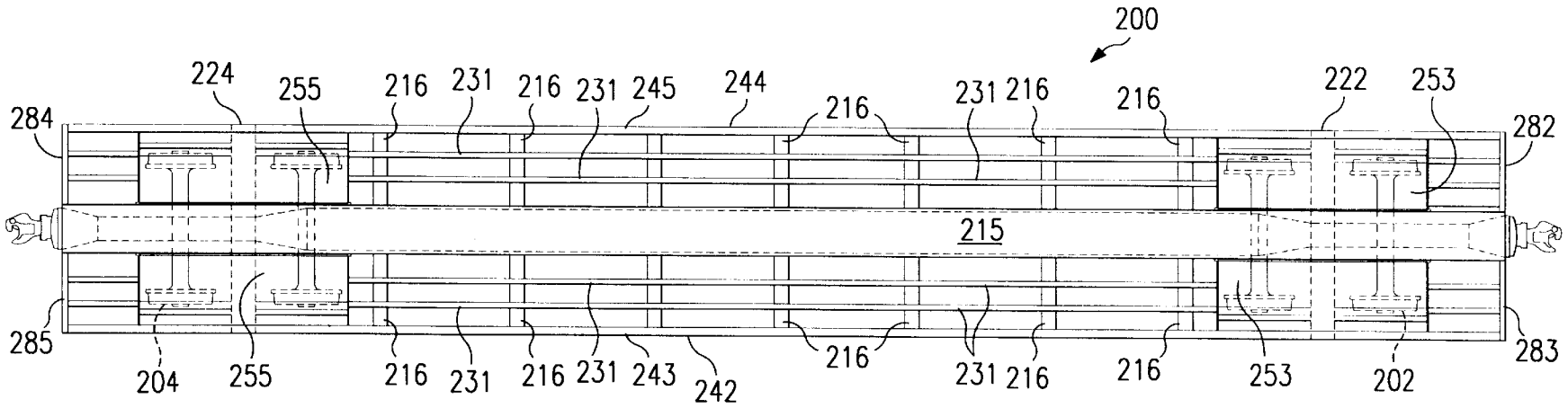
FIG. 1 is plan view of a railway car underframe in accordance with the present invention.

The preferred embodiments of the present invention and its advantages are best understood by referring to the drawings, like numerals being used for like and corresponding parts of the various drawings.

The present invention includes providing a floor system for railway cars. The floor system may include nailess floor panels consisting of one-piece floor plates. The floor plates may be attached to reinforcing members. The floor plates may be disposed within the confines of side sills and end sills of a railway car underframe, and may abut each other in a side-by-side arrangement to provide an overall floor structure for a railway car.

Figure 2:
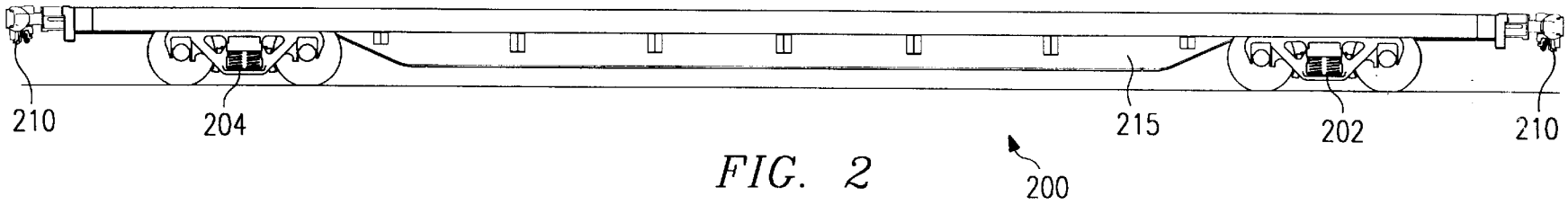
FIG. 2 is an elevation of the railway car underframe of FIG. 1.

An example of a railway car underframe 200 is shown in FIGS. 1 and 2. Underframe 200 is an example of an underframe which may be used in conjunction with the floor system of the present invention. Other types of underframes may be used. Underframe 200 includes first and second end sills 285 and 283 located at first and second ends 284 and 282, respectively, of underframe 200. First and second side sills 243 and 245 are provided on first and second sides 242 and 244, respectively, of underframe 200. The end sills and side sills cooperate to form a generally rectangular sill arrangement. A plurality of cross bearers 216 are provided to connect first and second side sills 243 and 245, respectively, with a center sill 215. A plurality of stringers 231 are provided for floor support and extend longitudinally with respect to underframe 200. First wheel pans 255 and second wheel pans 253 are provided over first truck assemblies 204 and 202, respectively. A pair of coupler assemblies 210 are provided at opposite ends of underframe 200.

Figure 3:
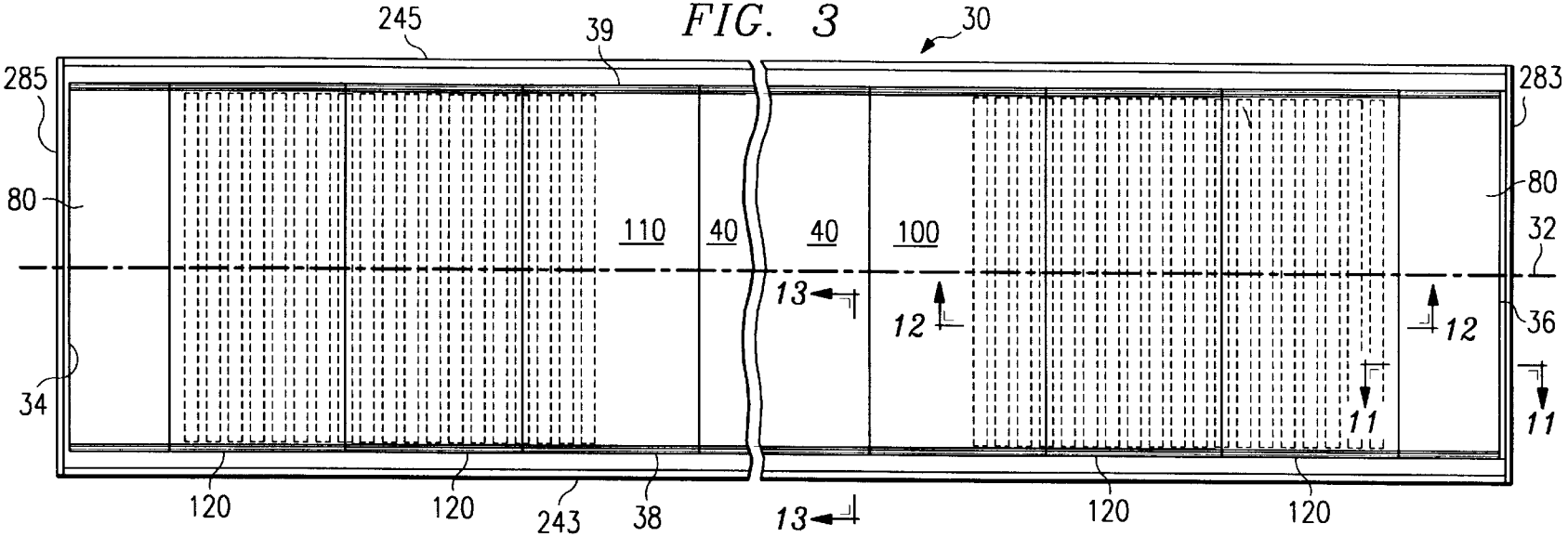
FIG. 3 is a schematic of a floor system in accordance with a first embodiment of the present invention.

Floor structure 30 incorporating teachings of the present invention is shown in FIG. 3. In general, floor structure 30 may be provided upon underframe 200. For purposes of illustrating various teachings of the present invention, floor structure 30 will be described with respect to installation within a railway freight car or railway boxcar. However, the present invention may be satisfactorily used to form a floor structure in various types of vehicles or containers and is not limited to railway freight cars or railway car underframes.

During the assembly of a railway freight car or railway box car, the railway car underframe is generally manufactured first and an enclosed structure mounted on the railway car underframe. Floor structure 30, as shown in FIG. 3, may then be installed within the enclosed structure and securely attached to the railway car underframe. Floor structure 30 is preferably welded to selected portions of the railway car underframe.

Floor panels or floor plate assemblies incorporating teachings of the present invention may be easily modified for use with a wide variety of railway car underframes and various types of railway freight cars and box cars, while satisfying appropriate structural design requirements of the AAR. Among other things, the present invention allows fabrication of floor panels, floor plates and reinforcing members with the required configuration and dimensions prior to installation of the resulting floor structure during assembly of the associated railway freight car.

For the embodiment of the present invention shown in FIG. 3, floor structure 30 has a generally rectangular configuration with an overall length of approximately 60.5 feet and a width of approximately 9.5 feet. The various dimensions shown on the drawings are for only one embodiment of the present invention, and are not limitations on the scope of the invention. The present invention allows various floor panels, including floor plates and reinforcing members, to be fabricated such that when assembled with each other, the dimensions and configurations of the resulting floor structure will be compatible with the require the associated railway car underframe and enclosed structure.

Center line 32 of floor structure 30 corresponds with the center line of the associated railway freight car and the center line of the railway car underframe. Floor structure 30 has a generally rectangular configuration corresponding approximately with the configuration of the associated railway car underframe. First and second ends 34 and 36 of floor structure 30 are disposed adjacent to respective end sills 285 and 283 of underframe 200 of the associated railway car. First and second sides 38 and 39 of floor structure 30 are disposed adjacent to respective side sills 243 and 245 of underframe 200 of the associated railway car.

For the embodiment shown in FIG. 3, floor structure 30 preferably includes eight (8) floor panels or floor plate assemblies 40. For purposes of describing the present invention, floor panels or floor plate assemblies 40 may sometimes be referred to as "standard floor panels." For the embodiment shown in FIG. 3, two (2) floor panels 80 at opposite ends 34 and 36 of floor structure 30 are preferably attached to the railway car underframe adjacent to respective end sills 285 and 283. Floor structure 30 also includes floor panels 100 and 110, along with four (4) floor plates 120 which will be described below in greater detail.

Floor panels 80, 100 and 110 may sometimes be referred to as "modified floor panels." One of the technical benefits of the present invention includes providing modified floor panels and floor plates to accommodate various types of railway car underframes and/or enclosed structures as required for each specific railway freight car.

Floor structure 30 includes floor panels 80, 100 and 110, along with floor plates 120 to accommodate attaching floor structure 30 to a railway car underframe having wheel pans or cover plates 253 and 255. Such wheel pans are typically mounted on center sill 215 of the railway car underframe adjacent to and extending over the associated railway trucks to protect the bottom of the associated floor structure 30. A wheel pan 253, for example, is shown by dotted lines in FIG. 12.

Floor panels 40, 80, 100 and 110 include floor plates 42, 82, 102 and 112, respectively. For the embodiment of the present invention as shown in FIG. 3, floor plates 42, 102, 112 and 120 have the same generally rectangular configuration with a length which corresponds generally to the distance between the side sills of the associated railway car underframe and the width of the associated enclosed structure. For the embodiment of the present invention as shown in FIG. 1, the length of each of the floor plates 42, 102, 112 and 120 are less than the width to accommodate a bulkhead track system. Floor plates 42, 102, 112 and 120 each have a length of approximately one hundred inches and a width of approximately eighty inches.

Floor plates 82 have a length of approximately one hundred inches. However, the width of floor plates 82 is approximately twenty-seven inches which is substantially reduced as compared to the width of floor plates 42, 102, 112 and 120. The width of floor plates 82 is selected to accommodate the distance between wheel pans 253 or wheel pans 255 and the respective end sill 283 or 285. Thus, the width of floor plates 82 and the respective floor panels 80 may be varied depending upon the location of each railway truck and its respective wheel pans relative to the adjacent end sill of the railway car underframe.

The number of floor panels and floor plates used to form floor structure 30 is selected such that the combined width of the floor plates will be approximately equal to the length of the associated railway car underframe between the end sills. By forming floor panels 40, 100, and 110 with respective floor plates 42, 102, and 112 having approximately the same width, material costs, manufacturing costs and installation procedures for the resulting floor structure 30 may be substantially reduced.

The longitudinal center line of each floor plate 42, 82, 102, 112 and 120 is preferably oriented substantially normally to center line 32 of floor structure 30. As will be discussed below in greater detail, adjacent edges of each floor plate 42, 82, 102, 112 and 120 are preferably butt welded with each other and to a respective reinforcing member 44*a* disposed between the adjacent edges and portions of the railway car underframe. For some applications floor plates 42, 82, 102, 112 and 120 may be formed from ten gauge (10GA.) steel which meets the requirements of ASTM A 604 GR55.

Figure 4:
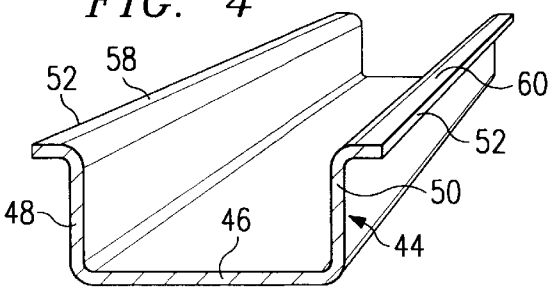
FIG. 4 is a perspective view of a reinforcing member in accordance with the present invention.

Each floor panel 40, 80, 100 and 110 includes one or more reinforcing members 44 attach to one side of each floor panel. Reinforcing member 44 may be generally described as a U-shaped channel or supporting beam. As best shown in FIG. 4, each reinforcing member 44 has a generally U-shaped cross-section defined by web 46 and flanges or legs 48 and 50 extending therefrom. End 52 of each vertical flange 48 and 50 opposite from web 46 is preferably folded or bent outwardly to provide respective attachment surfaces 58 and 60.

For the embodiment as shown in FIG. 3, each reinforcing member 44 preferably has an overall length of approximately eight feet and a width of approximately three inches. The height of each flange or leg 48 and 50 is approximately 1.6 inches. Reinforcing members 44 are preferably formed from nine gauge (9 GA.) steel satisfying the requirements of ASTM A 607 GR55 to provide floor structure 30 satisfactory for use in railway freight cars subject to lift truck axial loads of eighty thousand pounds. In another embodiment described below, a floor structure 330 is described for use in railway freight cars subject to lift truck axial loads of sixty thousand pounds. In that embodiment, reinforcing members 344 are preferably formed from ten gauge (10 GA.) steel satisfying the requirements of ASTM A 604 GR55. The general structure of each embodiment may be used for both sixty thousand pound floors and eighty thousand pound floors.

The differences between floor panels 40, 80, 100 and 110 include the number of reinforcing members 44 which are attached to one side of the respective floor plates 42, 82, 102 and 112, and variation in the width of the respective floor plates and/or slots which may be formed in portions of the respective floor plates. With reference to FIGS. 5, 6, 7 and 8, floor panel 40 will now be described in greater detail. The differences between floor panel 40 and the floor panels 80, 100 and 110 will then be described.

Figure 8:
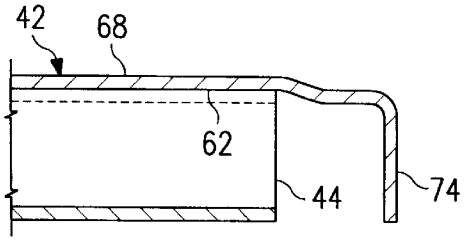
FIG. 8 is a partial cross-sectional view of the floor system of FIG. 3 taken along arrows 8—8 in FIG. 5.
Figure 7:
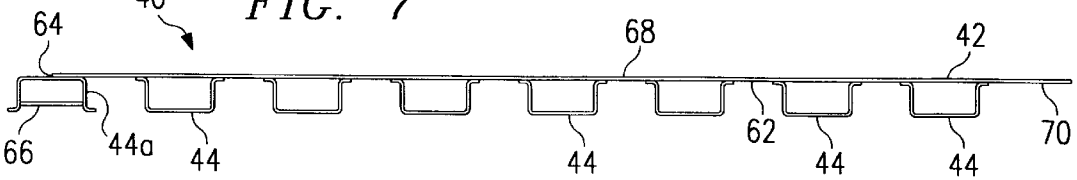
FIG. 7 is a side view of a floor panel in accordance with the first embodiment of the present invention.

As best seen in FIGS. 7 and 8, floor panel 40 preferably includes seven reinforcing members 44 attached to side 62 of floor plate 42. Supporting member 44*a* is also attached to side 62 along edge 64 of plate 42. Reinforcing member 44*a* is similar to previously described reinforcing members 44, except metal strip 66 has been installed between flanges 48 and 50 adjacent to the respective ends 52. As discussed below in greater detail, metal strip 66 prevents the respective flanges 48 and 50 from spreading away from each other when a load is placed upon floor structure 30 immediately over the respective reinforcing member 44*a*.

The number of reinforcing members 44 and 44*a*, the width of web 46, and the spacing between adjacent reinforcing members 44 and 44*a*, are selected to result in each leg or flange 48 and 50 being equally spaced from each other laterally across the width of floor plate 42. As a result of this configuration, loads placed on opposite side 68 of floor plate 42 may be more uniformly distributed with respect to the associated flanges 48 and 50 to minimize any deformation of floor plate 42.

Figure 5:
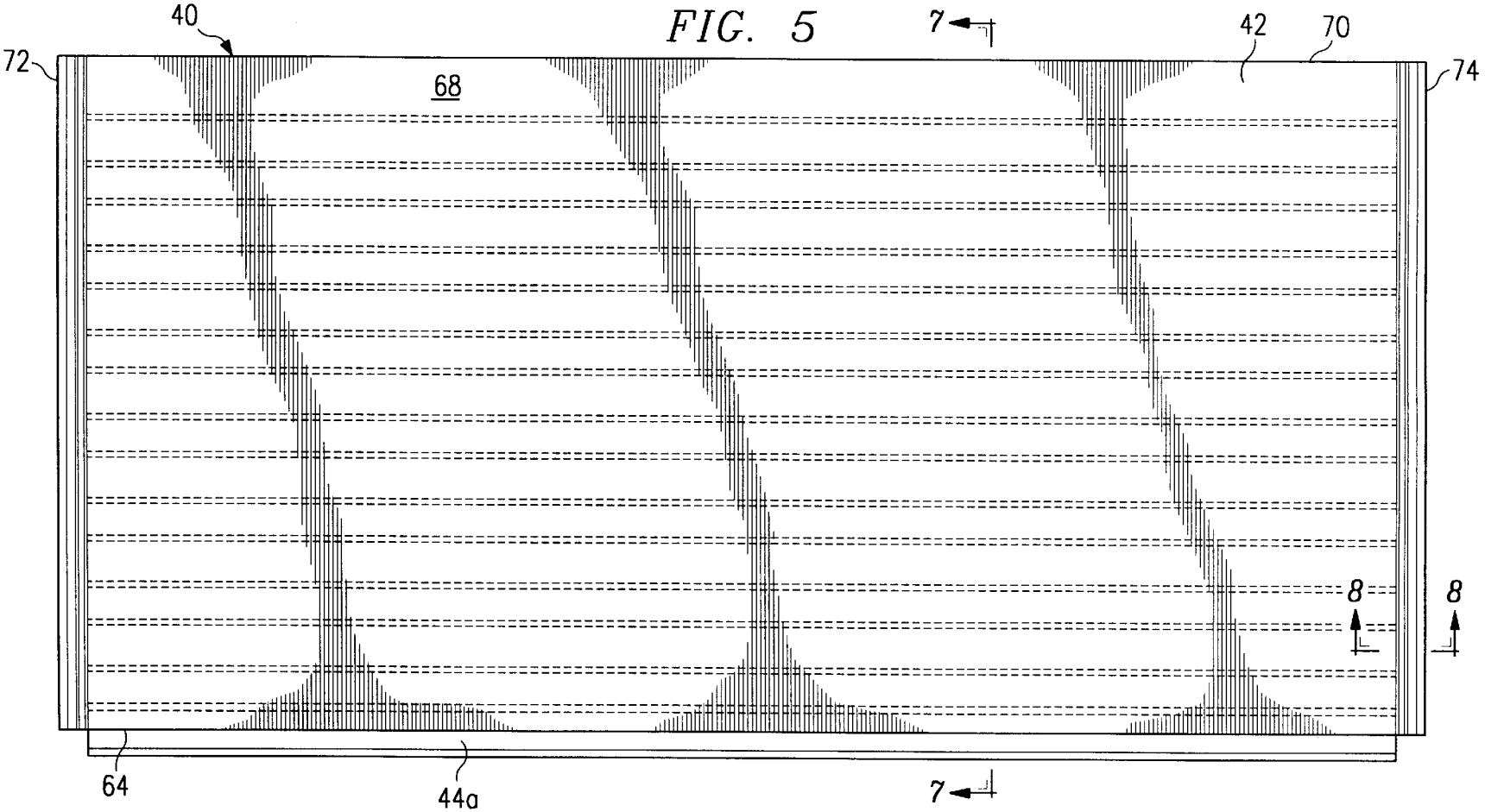
FIG. 5 is a plan view of a floor panel in accordance with a first embodiment of the present invention.
Figure 6:
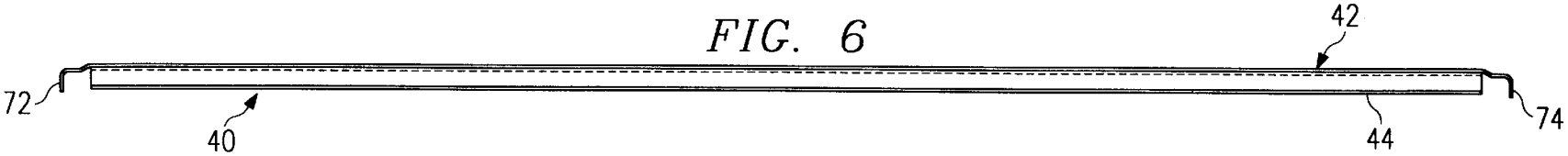
FIG. 6 is an elevation of the floor panel of FIG. 5.

Floor plate 42 includes first longitudinal edge 64 and second longitudinal edge 70 which extend parallel to each other and spaced laterally from the longitudinal center line of floor panel 40. As best seen in FIGS. 5 and 6, floor plate 42 also includes first end 72 and second end 74. Ends 72 and 74 are disposed opposite from each other with first edge 68 and second edge 70 extending there between.

Second longitudinal edge 70 of floor plate 42 extends laterally from a second edge reinforcing member 44 located proximate second longitudinal edge 70. A first edge reinforcing member 44*a* is preferably attached proximate first edge 64 of floor plate 42 with first edge 64 disposed approximately adjacent to the center line of the respective web 46. As a result, a portion of the respective web 46 extends laterally from first longitudinal edge 64 to provide support for edge 70 and adjacent portions of floor plate 42 of a second floor panel 40. This is shown, for example, in FIG. 15. Preferably, a butt weld is formed between the adjacent edges 64 and 70 extending the length of the associated reinforcing member 44*a*.

Figure 15:
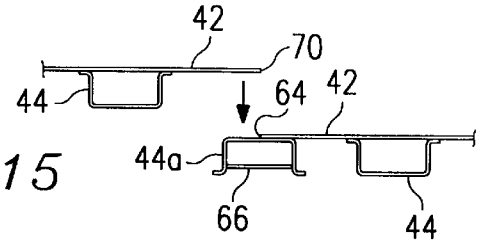
FIG. 15 is a partial side view of a floor system in accordance with the first embodiment of the present invention.

When a load is placed upon the joint between adjacent floor panels 40, the respective flanges or legs 48 and 50 may tend to spread laterally away from each other. As previously noted, metal strip 66 is preferably secured to respective flanges 44, 48 and 50 to prevent such spreading. The joint between floor plates 42, 82, 102, 112 and 120 are preferably formed as shown in FIG. 15.

The floor plates 42, 82, 102, 112 and 120 may be formed from an appropriately sized roll of steel (not shown). Preferably, plates 42, 82, 102, 112 and 120 are each one-piece plates. This results in floor panels having smooth surfaces without grooves, as would be the case for panels having plates consisting of multiple nested strips. According to one application, the floor plates may be formed from ten gauge (b 10GA.) steel satisfying the requirements of ASTM 607 GR55 or its equivalent. The end of each floor plate is preferably folded or bent to facilitate assembly within the associated enclosed structure. Each floor plate is preferably aligned such that the grain of the rolled steel runs substantially parallel with the longitudinal center line of the associated floor panel, such that the ends may be bent in a direction which is generally normal to the grain of the rolled steel. The length of reinforcing members 44 and 44*a* is preferably less than the length of the associated floor plate 42, 82, 102, 112 and 120. Thus, each end of the respective floor plate may be bent downwardly as shown, for example, in FIG. 6.

The first edge of one floor plate may be positioned relatively close to the second edge of an adjacent floor plate and a butt weld formed therebetween. First end 72 and second end 74 are bent downwardly to contact adjacent portions of the railway car underframe and to assist in providing a leak tight seal around the perimeter of floor structure 30.

Figure 11:
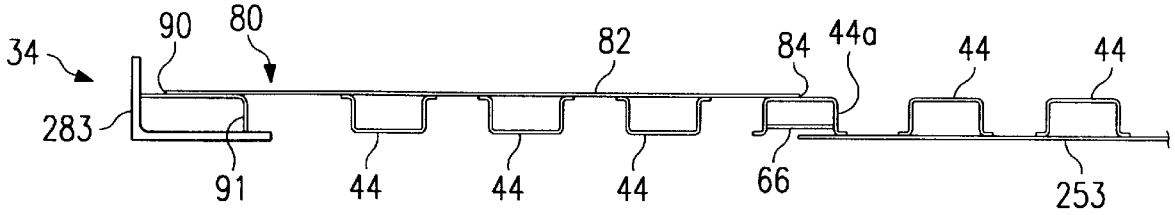
FIG. 11 is a partial cross-sectional view of the floor system of FIG. 3 taken along arrows 11—11 in FIG. 3.
Figure 14:
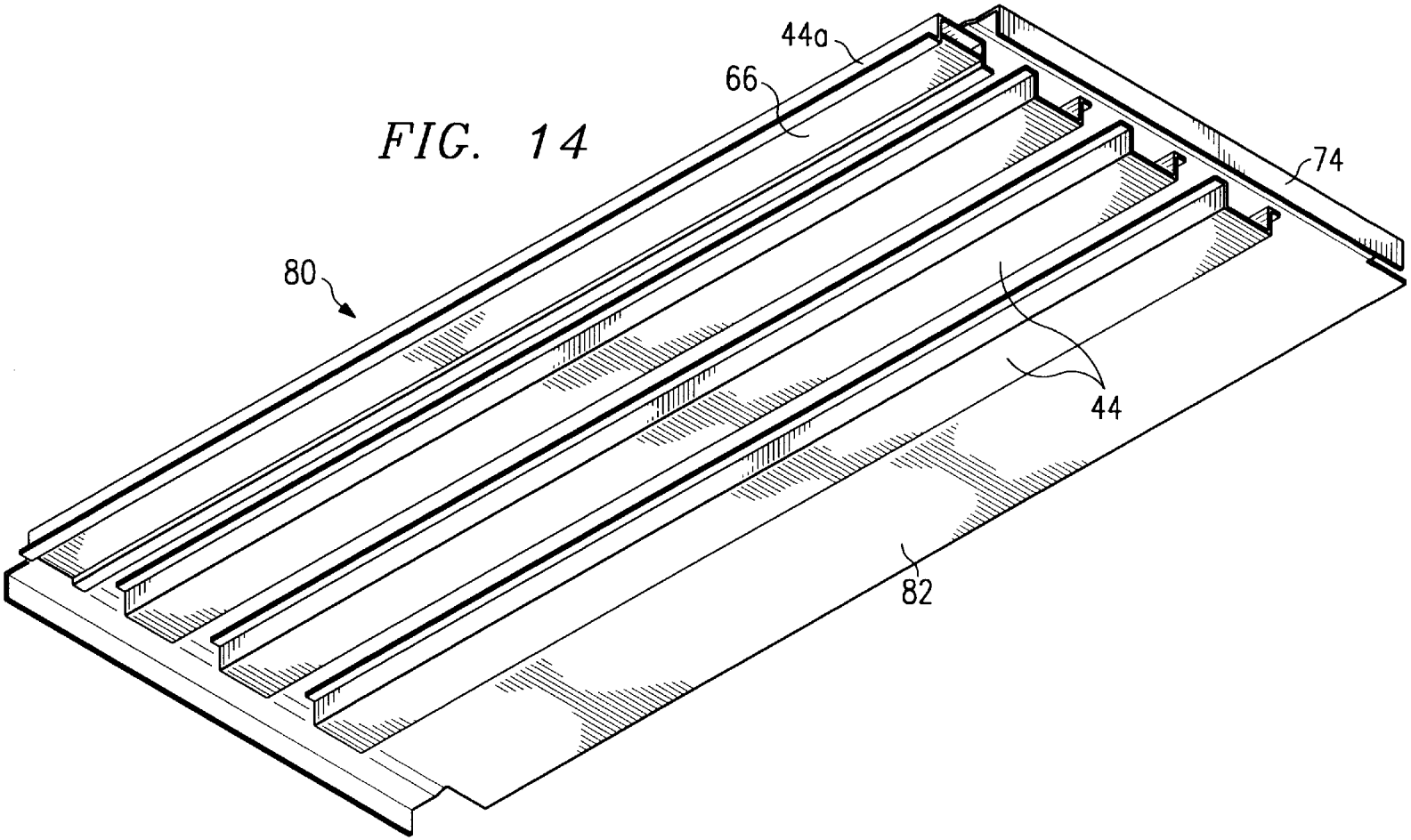
FIG. 14 is an isometric view of a floor panel in accordance with the first embodiment of the present invention.

Floor structure 30, as shown in FIG. 1, is preferably installed starting at second end 282 and continuing toward first end 284 of the associated railway car underframe. FIG. 11 is a schematic drawing in section showing the relationship between end sill 283 and the adjacent wheel pans 253. As previously noted, the width of floor plate 82 for floor panel 80 is less than the width of the other floor plates. Also, as best seen in FIG. 14, floor panel 80 includes only three reinforcing members 44 and one reinforcing member 44*a*. Reinforcing member 44*a* is attached to a first edge 84 of floor plate 82 in the same manner as previously described for first edge 64 of floor plate 42. Second edge 90 extends laterally from the adjacent supporting member 44 and may be attached to an appropriately sized supporting surface 91 provided as part of end sill 283. The interfacing between floor panel 80, end sill 285 and wheel pans 255 is accomplished in a similar manner.

Figure 12:
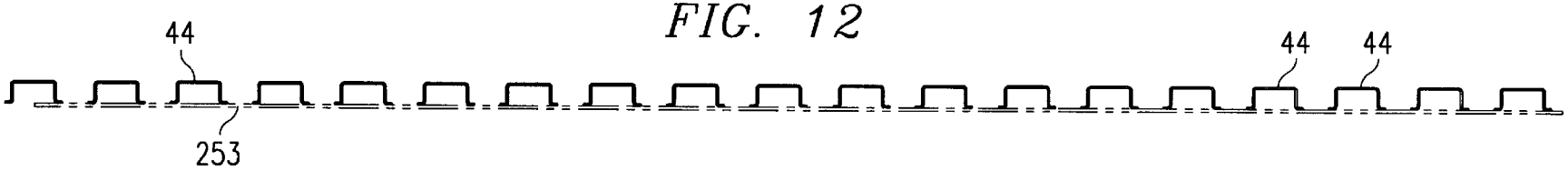
FIG. 12 is a partial cross-sectional view of the floor system of FIG. 3 taken along arrows 12—12 in FIG. 3.

As best shown in FIGS. 11 and 12, a plurality of reinforcing members 44 may then be disposed on the respective wheel pans 253. Each reinforcing member 44 is preferably oriented with its associated attachment surfaces 58 and 60 in contact with wheel pans 253 such that the respective web 46 projects vertically from the associated wheel pans 253. For one application a number of skip welds are preferably formed longitudinally along the respective attachment surfaces 58 and 60 and adjacent portions of wheel pans 253. For one application, each skip weld (not expressly shown) has a length of approximately two inches with a spacing of approximately ten inches between the center of adjacent welds.

Figure 10:
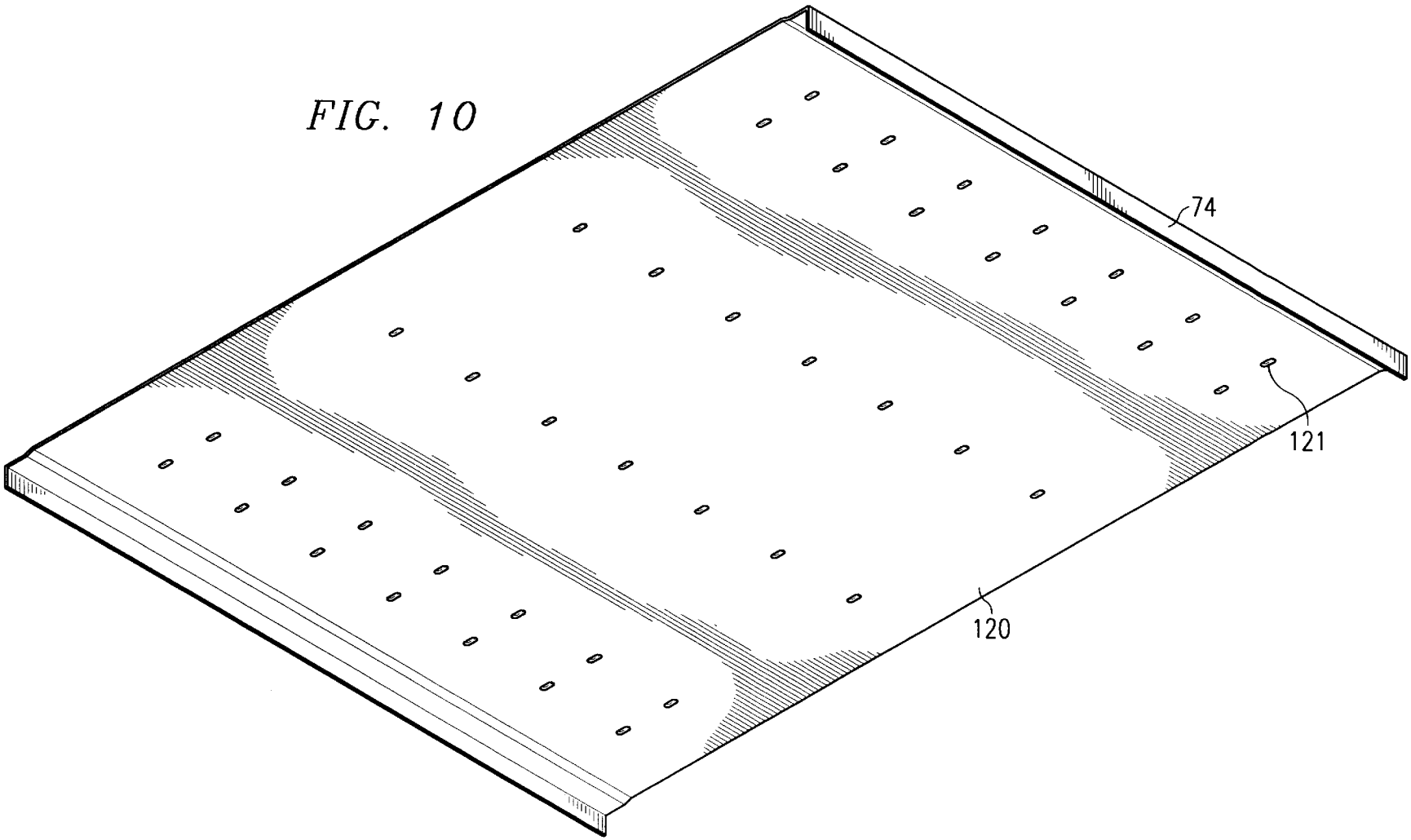
FIG. 10 is an isometric view of a floor plate in accordance with the first embodiment of the present invention.

As best seen in FIG. 10, each floor plate 120 is preferably formed with a plurality of slots 121 extending therethrough. The slots are preferably arranged in columns and rows to form a grid pattern corresponding with the spacing between reinforcing members 44 attached to the respective wheel pans 253. For one application, a grid having six slots longitudinally and seven slots laterally has been satisfactorily used for attaching floor plates 120 with reinforcing members 44. The location of each slot is selected to correspond with the center line of a respective reinforcing member 44 disposed between floor plate 120 and wheel pans 253. An appropriate weld may be formed within each slot and the portion of web 46 exposed through the slot.

Figure 9:
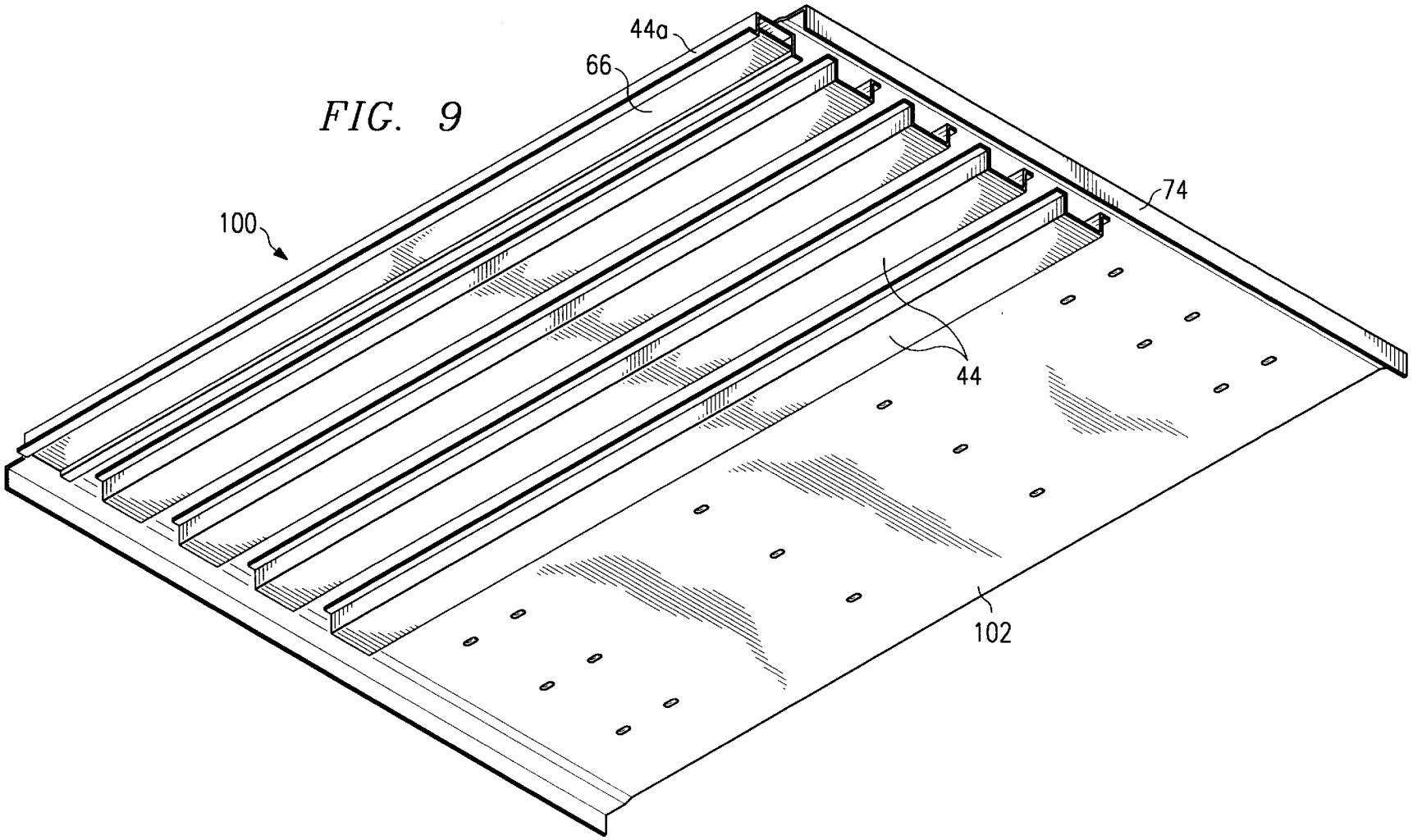
FIG. 9 is an isometric view of a floor panel in accordance with the first embodiment of the present invention.

As best seen in FIG. 9, floor panel 100 has a configuration and overall dimensions corresponding approximately with floor panel 40. However, floor panel 100 preferably has only four reinforcing members 44 and one reinforcing member 44*a* attached to one side of the respective floor plate 102. The portion of floor panel 100 extending from reinforcing member 44 is substantially wider than the portion extending from reinforcing member 44 of floor plate 42. Three rows of slots are preferably formed in this portion and positioned over corresponding reinforcing members 44 that have been attached to wheel pans 253. For one application, the slots in both floor plates 120 and 102 may have a diameter of approximately one-third of an inch and a length of approximately one inch.

Eight floor panels 40 may then be installed adjacent to each other with the second edge 70 of one panel 40 disposed adjacent to the first edge 64 of another panel 40. Floor panel assembly 110 is similar to floor panel 100 except the location of reinforcing members 44 and 44*a* is reversed to accommodate the location of wheel pans 255.

Floor plates 120 are preferably placed on reinforcing members 44 which have been welded to wheel pans 255 adjacent to first end 284 of the railway car underframe. This is accomplished in a manner similar to that described above for floor plates 120 and wheel pans 283. Floor panel 80 is then installed between floor plates 120 and end sill 285 at first end 284 of the associated railway car underframe. Reinforcing members 44 are preferably attached to wheel pans 253 and 255 as shown in FIG. 12 to prior to installation of floor plates 120. For floor panels 40, 80, 100 and 110, access is available within the railway car underframe to weld portions of each reinforcing member 44 with adjacent portions of the railway car underframe.

Figure 13:
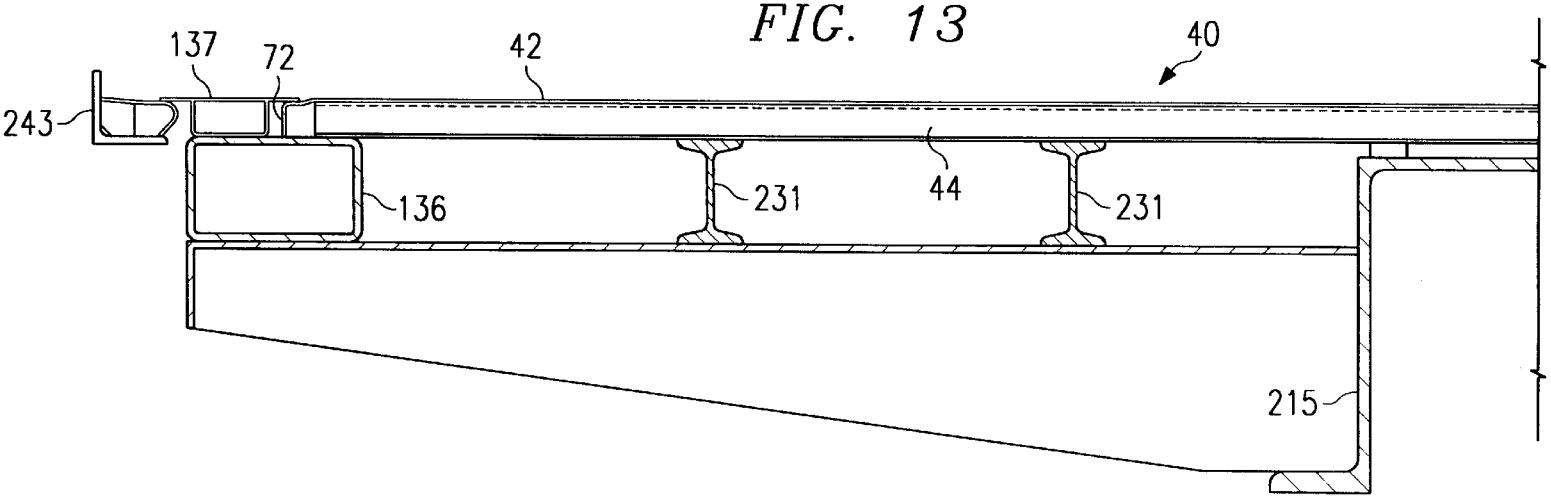
FIG. 13 is a partial cross-sectional view of the floor system of FIG. 3 taken along arrows 13—13 in FIG. 3.

Preferably, for the specific embodiment shown in FIG. 3 the length of the floor panels 40, 80, 100 and 110 is less than the overall width between the side sills associated with the railway car underframe. This arrangement may be used, for example, in railway freight cars subject to lift truck axial loads of eighty thousand pounds. FIG. 13 shows portions of the associated railway car underframe including center sill 215, longitudinal stringers 231, hollow tubing 136 and side sill 243. For the particular embodiment shown in FIG. 13, hollow tubing 136 extends along a substantial length of the adjacent side sill 243 to provide support for a bulkhead track assembly (not shown) which may be substituted for filler member 137. As shown in FIG. 13, the adjacent end 72 of floor panel 40 terminates prior to contacting the adjacent side sill 243.

End 72 (and end 74) preferably has a stepped-bend configuration. This may be achieved, for example, by bending the end of the floor plate downward, then outward, then downward again. The vertical dimension between the first and second bends is preferably relatively small. Therefore, the angle of the first and second bends is shallow and is preferably much less than 90 degrees. This angle is preferably on the order of about 5 to 40 degrees. More preferably, the angle is on the order of about 10 to 25 degrees.

Although FIG. 13 shows floor panel 40, the relationship between the floor panel and the side sill is similar for the other floor panels and/or plates (e.g., panels 80, 100 and 110, and plates 120). Also, the interfacing between the panels and side sill 243 is replicated at the opposite side sill 245. For some applications, as discussed in greater detail below, the length of floor plates 42, 82, 102, 112 and 120 may be increased such that the opposite ends of the respective floor plates contacts or rests upon the adjacent side sill.

Floor structure 30 has been described with respect to a railway car underframe having a center sill. For some applications floor structure 30 may be formed on a railway car underframe which includes sliding sills which are often used on conventional railway boxcars.

Loads placed on floor structure 30 are transmitted by the respective floor plates 42, 82, 102, 112 and 120 through legs or flanges 48 and 50 onto longitudinal stringer 231, cross bearers 216 and then to center sill 215. The railway car underframe may include a first pair of body bolsters 222 and a second pair of body bolsters 224 disposed over respective railway trucks 202 and 204. The body bolsters extend laterally between center sill 215 and the respective side sills 243 and 245.

The pairs of wheel pans or cover plates 253 and 255 are preferably formed from relatively thick metal plates to provide clearance for the wheels of the associated railway trucks. Preferably, wheel pans 253 and 255 are sized to accept loads from floor structure 30 and to transfer these loads to center sill 215. Pans 253 and 255 may also protect adjacent portions of floor structure 30 from any debris thrown from the respective railway trucks.

Figure 16:
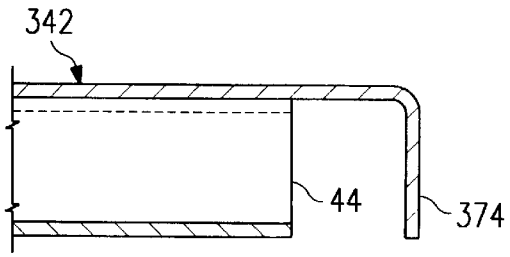
FIG. 16 is a partial cross-sectional view of a floor system in accordance with a second embodiment of the present invention.
Figure 17:
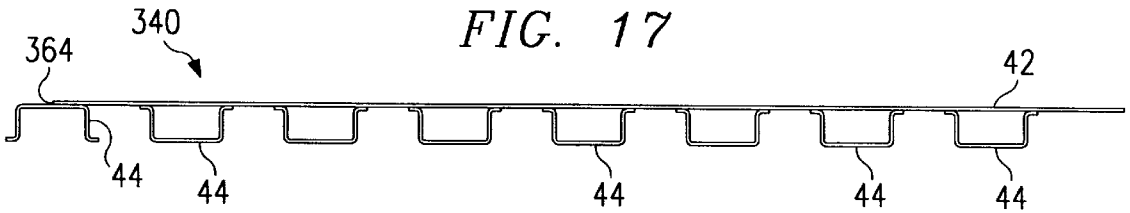
FIG. 17 is a partial side view of a floor panel in accordance with the second embodiment of the present invention.
Figure 18:
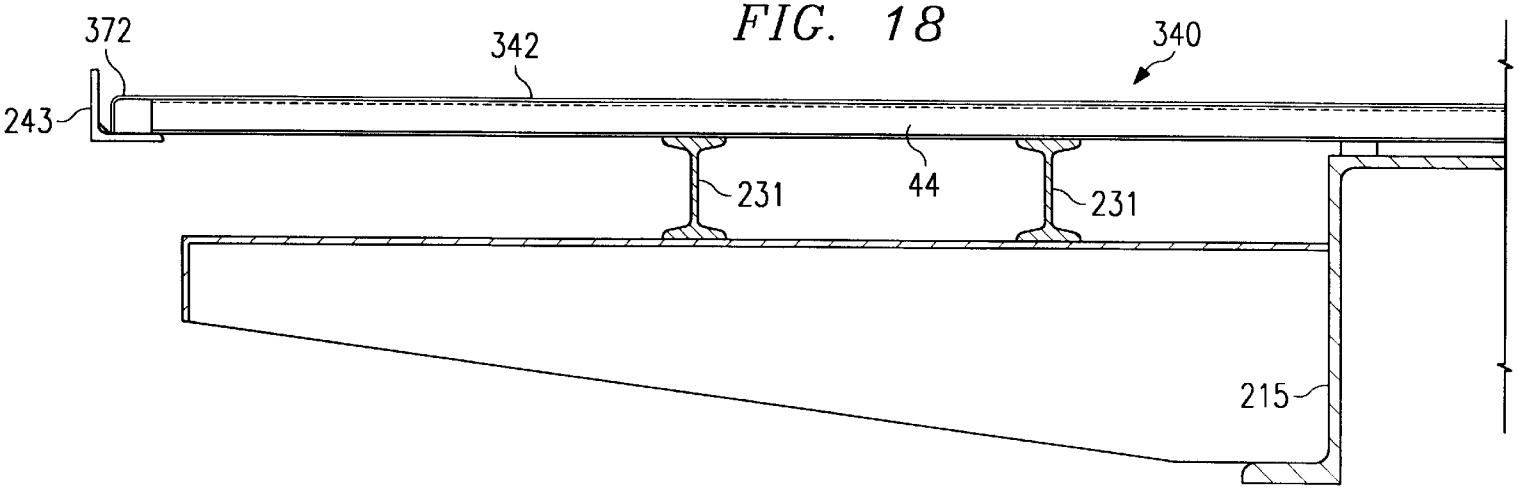
FIG. 18 is a partial cross-sectional view of a floor system in accordance with the second embodiment of the present invention.

An alternative embodiment is similar to that shown in FIG. 3, but has certain differences as best seen in FIGS. 16, 17 and 18. This embodiment may be used, for example, in railway freight cars subject to lift truck axial loads of sixty thousand pounds. One of the differences concerns the formation of the respective ends of the floor plates. As shown in FIG. 16, for example, end 374 of floor plate 42 has a single bend configuration as opposed to the stepped-bend configuration described above for the embodiment shown in FIG. 8. This configuration is also used for the respective ends of the other floor plates.

Also, as shown in FIG. 17, a reinforcing member 44, located at edge 364 for example, is substituted for reinforcing member 44*a*. More specifically, the reinforcing member located at the transition between plates lacks metal strip 66. This metal strip is unnecessary due to the reduced load.

Another difference concerns the relationship between the end 372 of the floor plate and the side sills (e.g., side sill 243). This is seen in FIG. 18. In this embodiment, the floor plates (e.g., floor plate 342) are of a length such that the respective ends thereof rest on the respective side sills. In this configuration, there is no bulkhead track and divider assembly and, therefore the hollow tubing 136 is also omitted. This configuration is also used for the other floor plates. It should be noted that any of the above embodiments may be used for sixty thousand pound floors, eighty thousand pound floors, or floors subject to other lift truck axial loads.

Although the present invention and its advantages have been described in detail, it should be understood that various changes, substitutions and alterations can be made herein without departing from the spirit and scope of the invention as defined by the following claims.

What is claimed is:

1. A floor system for a railway freight car having an underframe including a center sill disposed on a longitudinal center line of the underframe, a pair of side sills, a pair of end sills cooperating with the side sills to form a generally rectangular configuration, a plurality of cross bearers extending between the center sill and the side sills, a plurality of longitudinal stringers extending between the end sills and spaced laterally from each other between the center sill and the side sills, each longitudinal stringer being disposed on the one or more of the plurality of cross bearers, a pair of trucks attached to the underframe adjacent to each end of the center sill, a body bolster extending between the center sill and the side sills above each of the railway trucks, and a pair of wheel pans attached to and extending horizontally from each body bolster with the wheel pans sized to extend over the respective railway trucks, the floor system comprising:

a plurality of floor panels, each floor panel being disposed adjacent to another of the floor panels and extending between the side sills of the underframe, each floor panel having a longitudinal center line substantially normal to the center line of the underframe and approximately parallel with the longitudinal center line of an adjacent floor panel, each floor panel having a first floor plate with at least one first reinforcing member secured to the respective first floor plate, the at least one first reinforcing member extending longitudinally across the respective first floor plate approximately parallel with the center line of the respective floor panel, the at least one first reinforcing member resting on at least one of the longitudinal stringers, the respective first floor plate having a generally rectangular configuration with a first side having a first longitudinal edge and a second side having a second longitudinal edge, the first and second longitudinal edges extending between first and second ends of the respective first floor plate, a length of the at least one first reinforcing member being less than a length of the respective first floor plate, the first and second ends of the respective first floor plate being folded downwardly for contacting portions of the underframe.

2. The floor system of claim 1, further comprising:

a first edge reinforcing member attached to the respective first floor plate proximate the first longitudinal edge with a portion of the first edge reinforcing member extending laterally beyond the first longitudinal edge; and a second edge reinforcing member attached to the respective first floor plate proximate the second longitudinal edge, the second longitudinal edge extending laterally beyond the second edge reinforcing member, wherein the portion of the first edge reinforcing member extending beyond the first longitudinal edge provides a support for a second longitudinal edge of an adjacent first floor plate.

3. The floor system of claim 2 further comprising:

at least one second reinforcing member being disposed on each of the wheel pans, the longitudinal center line of the at least one second reinforcing member extending substantially normal to the center line of the underframe, the at least one second reinforcing member having a web with a pair of flanges extending therefrom, each of the flanges of the at least one second reinforcing member being attached to the wheel pans the web projecting upwardly from the wheel pans; and a second floor plate being attached to the web of the at least one second reinforcing member.

4. The floor system of claim 3 wherein the second floor plate has a plurality of openings extending therethrough and aligned with the center line of the at least one second reinforcing member, whereby each opening may be used to form a weld between the second floor plate and the web of the at least one second reinforcing member.

5. A floor system for a railway car having an underframe, the floor system comprising:

a plurality of nailess metal floor panels, each panel comprising a one-piece metal floor plate having a plurality of reinforcing members attached to a side thereof, the plurality of floor panels being arranged in a side-by-side relationship on the underframe to form a floor, at least one of the reinforcing members extending along and contacting abutting planar longitudinal edges of two of the plurality of floor panels to support the abutting planar longitudinal edges, wherein the underframe comprises first and second side sills, each floor plate having first and second ends, the floor plates longitudinally extending between and contacting the first and second side sills, respectively.

6. A floor system for a railway car having an underframe, the floor system comprising:

a plurality of nailess metal floor panels, each panel comprising a one-piece metal floor plate having a plurality of reinforcing members attached to a side thereof, the plurality of floor panels being arranged in a side-by-side relationship on the underframe to form a floor, at least one of the reinforcing members extending along and contacting abutting planar longitudinal edges of two of the plurality of floor panels to support the abutting planar longitudinal edges, wherein each of the plurality of floor panels is welded to an adjacent one of the floor panels along corresponding longitudinal edges thereof.

7. A floor system for a railway car having an underframe, the floor system comprising:

a plurality of nailess metal floor panels, each panel comprising a one-piece metal floor plate having a plurality of reinforcing members attached to a side thereof, the plurality of floor panels being arranged in a side-by-side relationship on the underframe to form a floor, at least one of the reinforcing members extending along and contacting abutting planar longitudinal edges of two of the plurality of floor panels to support the abutting planar longitudinal edges, each floor plate having first and second longitudinal ends being bent away from a plane defined by a surface of the floor plate.

8. The floor system of claim 7, wherein the first and second ends are bent in a stepped-bend configuration.

9. The floor system of claim 7, wherein the first and second ends are bent in a single-bend configuration.

10. The floor system of claim 6, wherein the underframe comprises first and second side sills, each floor plate having first and second ends, the floor plates longitudinally extending between the first and second side sills to form a gap between the first and second side sills and the first and second ends, respectively.

11. The floor system of claim 10, wherein the gap is adapted to receive a bulkhead track assembly.

* * * * *